US006536078B2

(12) United States Patent
Tsai

(10) Patent No.: US 6,536,078 B2
(45) Date of Patent: Mar. 25, 2003

(54) RETRACTABLE HANDLE FOR A CASE

(76) Inventor: James Tsai, No. 103, Ta-Ming 1 Rd., Tung Pao Village, Tan Tzu Hsian, Taichung Hsien (TW)

( * ) Notice: Subject to any disclaimer, the term of this patent is extended or adjusted under 35 U.S.C. 154(b) by 0 days.

(21) Appl. No.: 09/906,642

(22) Filed: Jul. 18, 2001

(65) Prior Publication Data

US 2003/0014837 A1 Jan. 23, 2003

(51) Int. Cl.[7] ..... A45C 3/00
(52) U.S. Cl. ..... 16/114.1; 16/444; 190/115
(58) Field of Search ..... 16/114.1, 113.1, 16/429, 444; 190/115, 116, 902, 39, 18 A; 224/901.8; 150/108; 280/47.371, 47.34, 655, 655.1

(56) References Cited

U.S. PATENT DOCUMENTS

| | | | | | |
|---|---|---|---|---|---|
| 1,979,978 | A | * | 11/1934 | Martin | 190/115 |
| 3,604,052 | A | * | 9/1971 | Bringer et al. | 16/405 |
| 4,176,423 | A | * | 12/1979 | Wigemark | 16/405 |
| 4,508,202 | A | * | 4/1985 | Siegert et al. | 16/113.1 |
| 5,027,874 | A | * | 7/1991 | Gazzola | 150/107 |
| 5,294,029 | A | * | 3/1994 | Shimura et al. | 150/108 |
| 5,403,023 | A | * | 4/1995 | Tsai | 280/42 |
| 5,722,518 | A | * | 3/1998 | Aumasson | 190/115 |
| 5,806,638 | A | * | 9/1998 | Mao | 16/405 |
| 5,943,936 | A | * | 8/1999 | Deliman et al. | 16/113.1 |
| 6,279,706 | B1 | * | 8/2001 | Mao | 16/113.1 |

FOREIGN PATENT DOCUMENTS

| | | | |
|---|---|---|---|
| DE | 3246952 | A * | 12/1982 |
| FR | 2767256 | A3 * | 2/1999 |

* cited by examiner

*Primary Examiner*—Chuck Y. Mah
(74) *Attorney, Agent, or Firm*—Browdy and Neimark, P.L.L.C.

(57) ABSTRACT

A retractable handle, which is provided on a case, comprising two rail housings, provided substantial parallel on the lateral sides of the case. Between each of the rail housings and the case forming a slide rail respectively. A U shaped handle device, having two connecting means at the two ends of said handle device. The connecting means of said handle device are elastic belts, each of which slidedly engaged with said slide rails on the case respectively. Whereby said handle device can move between a collapsed position, in which said handle device moved toward the case and being against on the case, and a extended position, in which said handle device moved outward the case for a predetermined distance.

19 Claims, 5 Drawing Sheets

RETRACTABLE HANDLE FOR A CASE

FIELD OF THE INVENTION

The present invention relates to a handle of the case and, more particularly, to a retractable handle for a case.

BACKGROUND OF THE INVENTION

Retractable handles for a wheeled luggage are known in the prior art. The inventor that found such handle structure creates problems. First, the conventional retractable handle is a rigid body and takes up too much space of the receiving chamber of the luggage. This reduces the capacity of the luggage. Second, the known structure is complex, which increases the cost of manufacture as well as increasing the total weight of the wheeled luggage.

SUMMARY OF THE INVENTION

The primary objective of the present invention is to provide a retractable handle, which take less space of a case.

The other objective of the present invention is to provide a retractable handle, which has a simple structure.

In keeping with the principle of the present invention, the retractable handle of the present invention, which is provided on a case, comprising two slide rails provided substantial parallel on the case. An elongated handle device, having two elastic connecting means at the two ends thereof. The connecting means of the handle device are slidably engaged with said slide rails respectively, whereby said handle device can move between a collapsed position, in which said handle device is moved toward the case and against on the case, and a extended position, in which said handle device is moved outward from the case for a predetermined distance.

DETAIL DESCRIPTION OF THE INVENTION

Figure 1:
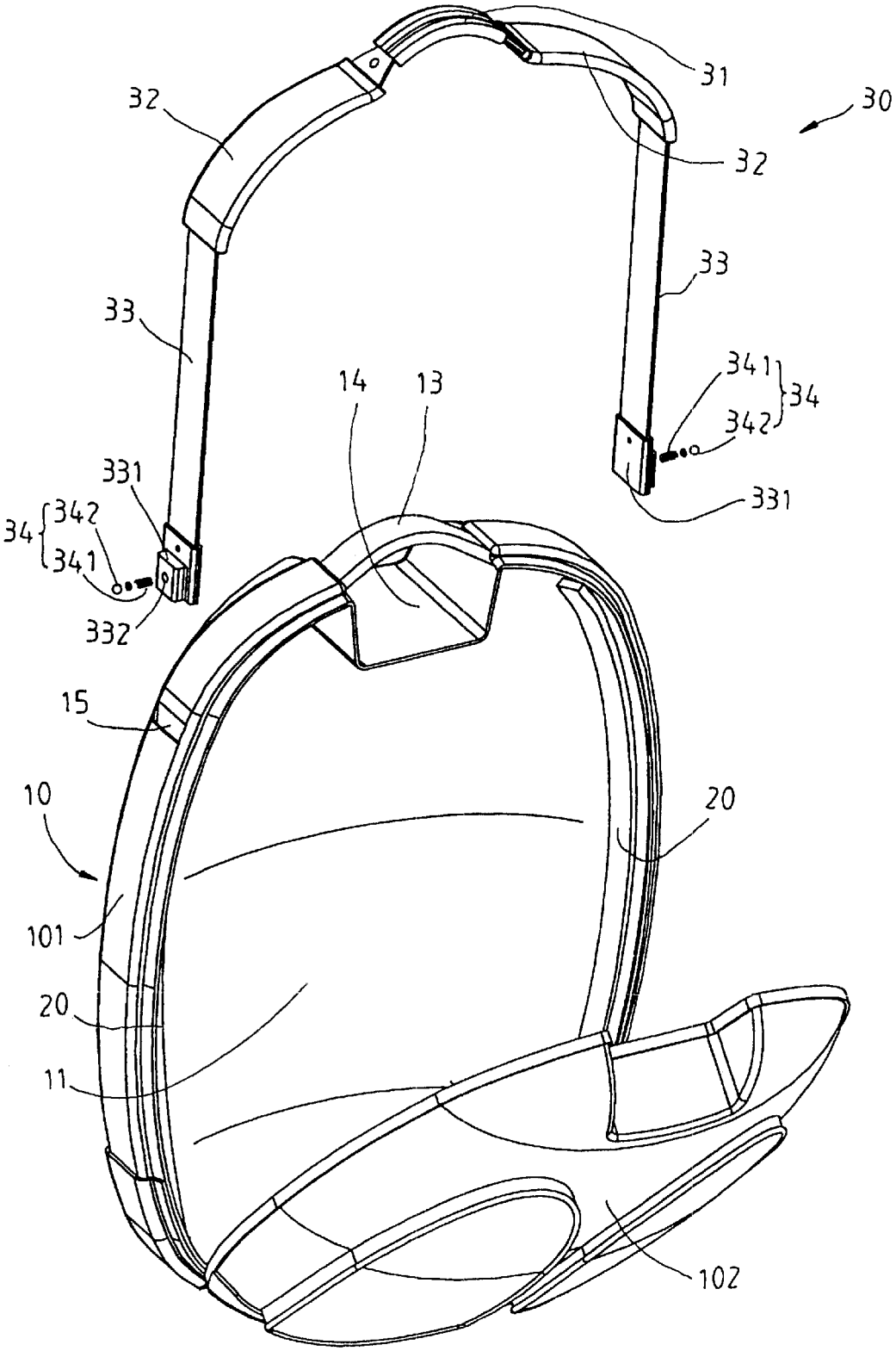
FIG. 1 shows a exploded view of the first embodiment of the present invention.

Please refer to FIG. 1, the case with a retractable handle of the embodiment of the present invention comprises:

A case body 10, which has an ellipse first case piece 101 and a second case piece 102, shaped like the first case piece 101. The bottom end of the second case piece 102 pivoted with the bottom end of the first case piece 101 and the top ends of both case pieces 101, 102 can lock together and unlock. Within the first case piece 101 and the second case piece 102 has a receiving chamber 11 for receiving goods or cloths. A case handle 13, disposed at the top side of the first case piece 101. And the first case piece 101 also has a slot 14 under the case handle for facilitating users to grip the case handle 13.

Figure 4:
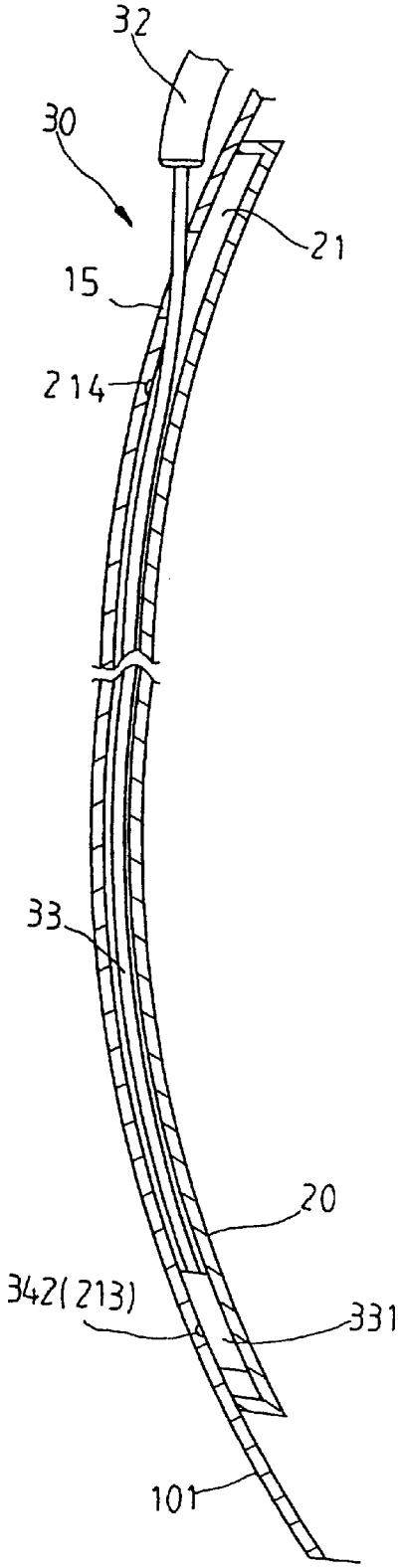
FIG. 4 is a sectional view, in which shows the first engagement of the slide rail and the connecting portions of the handle device when the handle device is located at the collapsed position.
Figure 5:
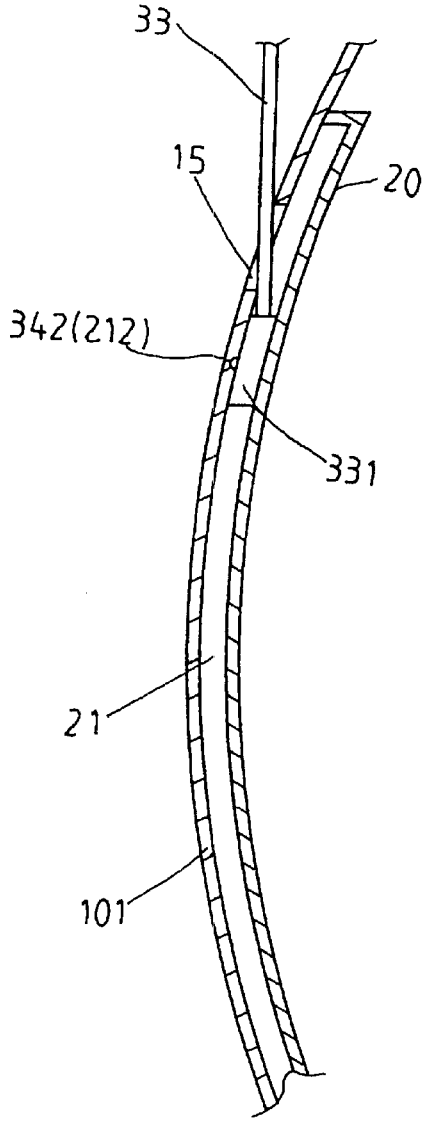
FIG. 5 is a sectional view, in which shows the first engagement of the slide rail and the connecting portions of the handle device when the handle device is located at the extended position.

Two rail housing 20, shown in FIGS. 1, 4 and 5, have a curved shape in order to fit the shape of the case body 10. The rail housings 20 are respectively fixed in the inner sides of the lateral sides of the first case piece 101 of the case body 10 to form two slide rails 21 between each of the rail housings 20 and the first case piece 101. The slide rails 21 are also curved. Two openings 15 disposed at each lateral side of the first case piece 101, going through the top sides of the slide rails 21. Within each of the slide rails 21, two slots 213, 214 are provided at the inner sides of the first case piece 101, positioned at the top sides and the bottom sides thereof. The slots 213, 214 will be discussed later.

The handle device 30, substantially is a U shape belt, which has a grip portion 31, two curved portions 32 and two connecting portions 33. The grip portion 31 is located at the central part of the handle device 30 and is designed for users to grip it by hand. The curved portions 32 are arch rigid pieces, provided at two ends of the grip portion 31. The curved portions 32 can be made of metal or plastic to keep the handle device 30 with a predetermined shape. The connecting portions 33 are made of composite material, like carbon fiber or glass fiber, to form two elastic elongated belts, each of which are located at the outer ends of the curved portion 32, respectively. Two stop blocks 331 provided at each of the outer ends of the connecting portions 33. At each of the outer sides of the stop blocks 311 have a position means 34. In this embodiment, each of the position means 34 has a spring 341 and a metal ball 342 installed into a small hole 337 on each stop block 331 in sequent. Whereby, the springs 341 can force the metal ball 352 outside the small slot or hole 332.

To manufacture the handle device 30 of the present invention, an elongated belt of composite material is made first. Next, a soft material is attached on the central part of the belt to form the grip portion 31, and two curved metal pieces are fixed on the belt at two side of the grip portion 31 to form the curved portions 32. The rest of the belt will form the connecting portions 33.

The connecting portions 33 of the handle device 30 are inserted into the slide rails 21 through the openings 15 of the case body 10, so that the handle device 30 is slidably engaged on the case body 10 with the connecting potions 33 sliding along the slide rails 21.

Figure 2:
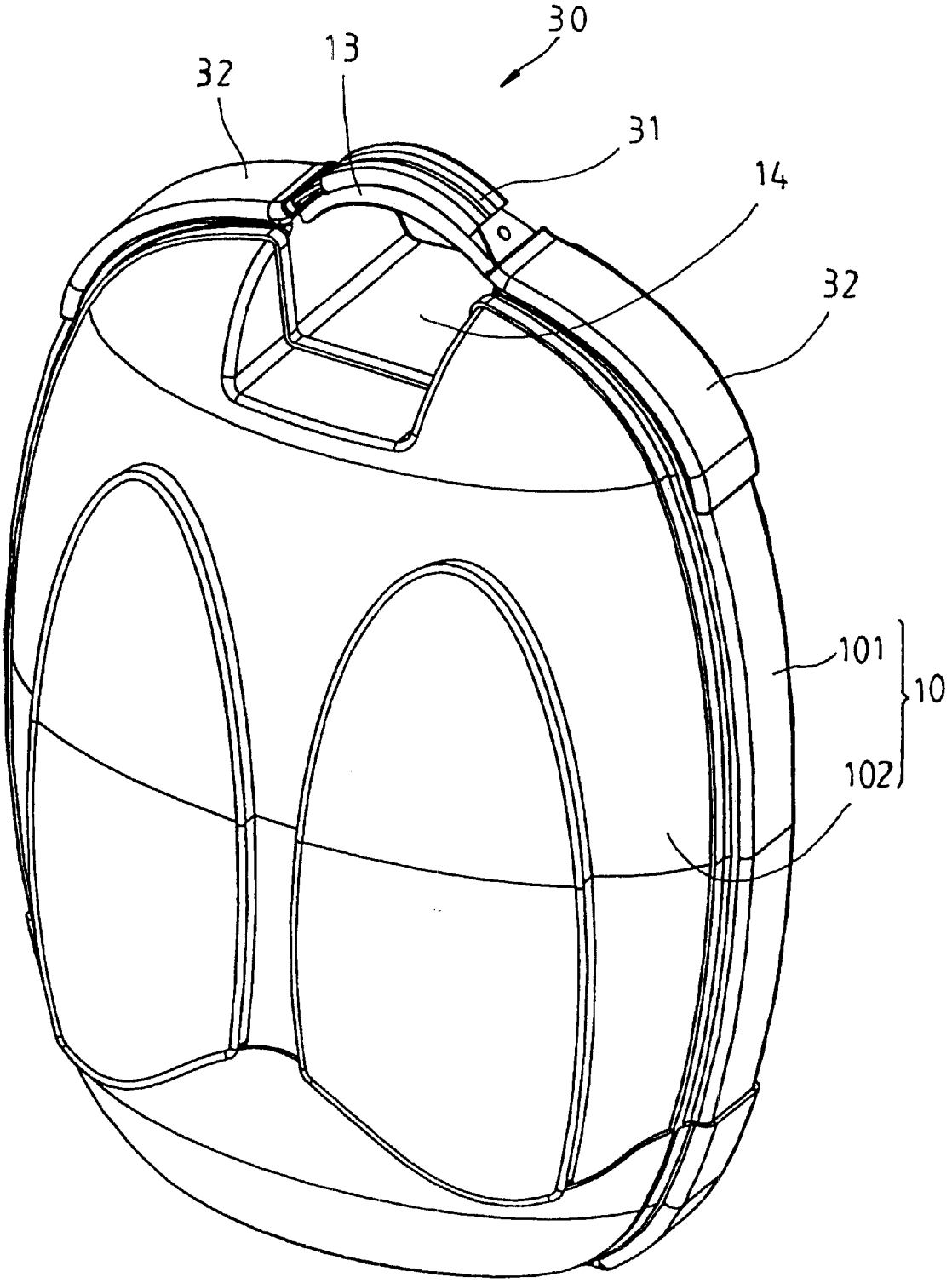
FIG. 2 is a perspective view of the first embodiment of the present invention, shows the handle device located at the collapsed position.

The handle device 30 can move toward the case body 10 to a collapsed position as shown in FIG. 2. In the collapsed position, the curved portions 32 are engaged against the case body 10, and the grip portion 31 is attached on the case grip 13 of the case body 10 so that a user can grip both grip portion 31 and case grip 13 to carry the case body 10. FIG. 4 shows that the outer ends of the connecting portions 33 of the handle device 30 can slide to the bottom sides of the slide rails 21. The metal balls 342 of the position means 34 will slide into the slots or holes 213 at the bottom sides of the slide rails 21. That will provide the handle device 30 a position capacity to keep the handle device 30 locating at the collapsed position.

Figure 3:
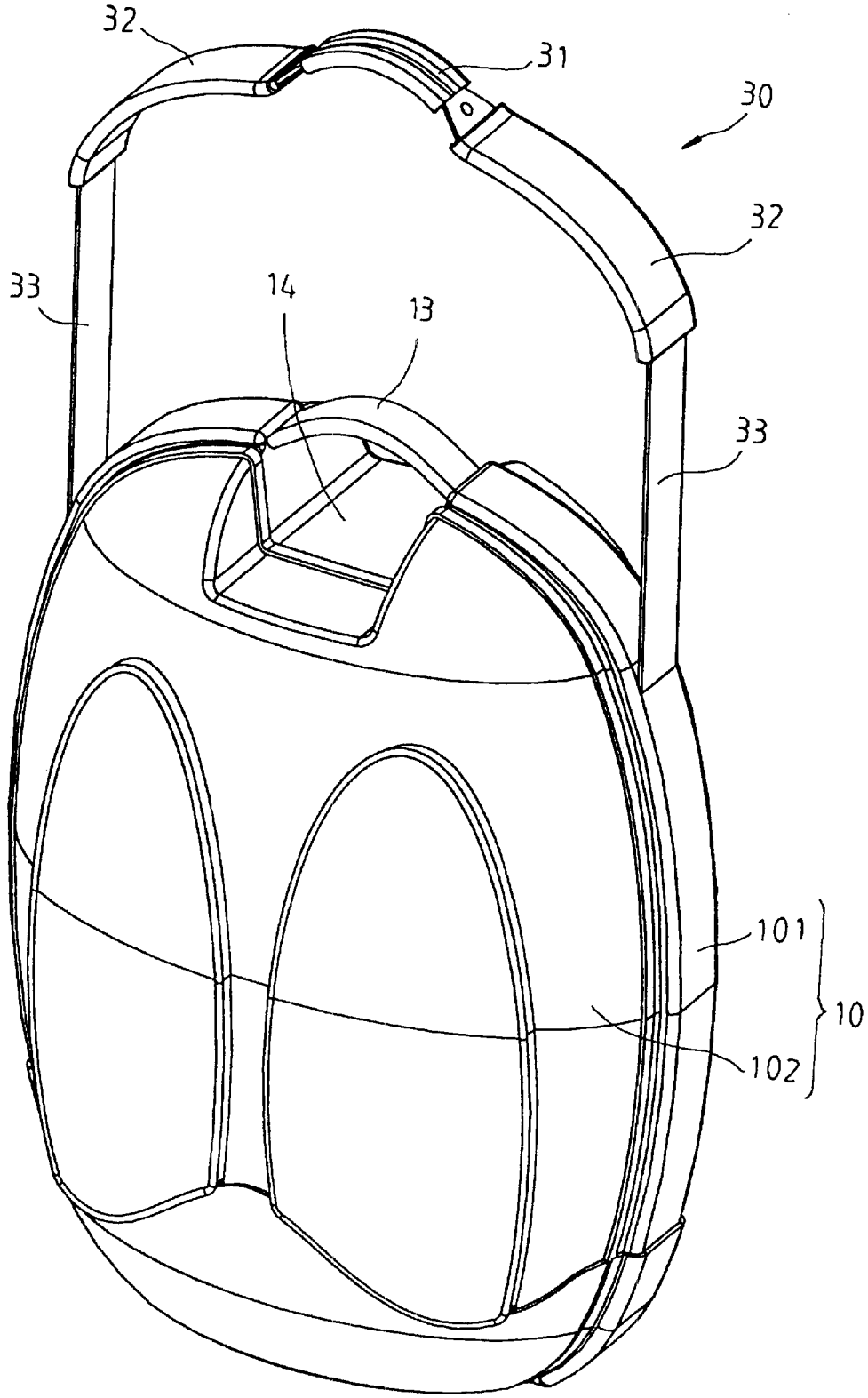
FIG. 3 is a perspective view of the first embodiment of the present invention, shows the handle device located at the extended position.

User also can pull the handle device 30 outward to an extended position as shown in FIG. 3. At this time, user can carry the case body 10 by hand or shoulder. At the extended position, as shown in FIG. 5, the stop blocks 331 will keep the connecting portions 33 of the grip device 30 from escaping from the slide rails 21. And the metal balls 342 of the position device 34 will slide into the slots or holes 212 at the top sides of the slide rails 21 to provide the handle device 30 a position capacity.

The present invention has the advantages hereunder:

1. The retractable mechanism is very simple, and takes less space of the case body 10. That will reduce the cost to manufacture and enlarge the receiving chamber 11 of the case body 10 so as to make more space to store goods.
2. The connecting portions 33 of the handle device 30 are made of elastic material, e.g. carbon fiber or glass fiber composite material, so the slide rails 21 on the case body 10 had no longer to be limited in straight. That should make the designer can design the case body 10 into any shape as he/she wanted and the structure of the case body 10 will not be limited by the handle device 30.

Figure 6:
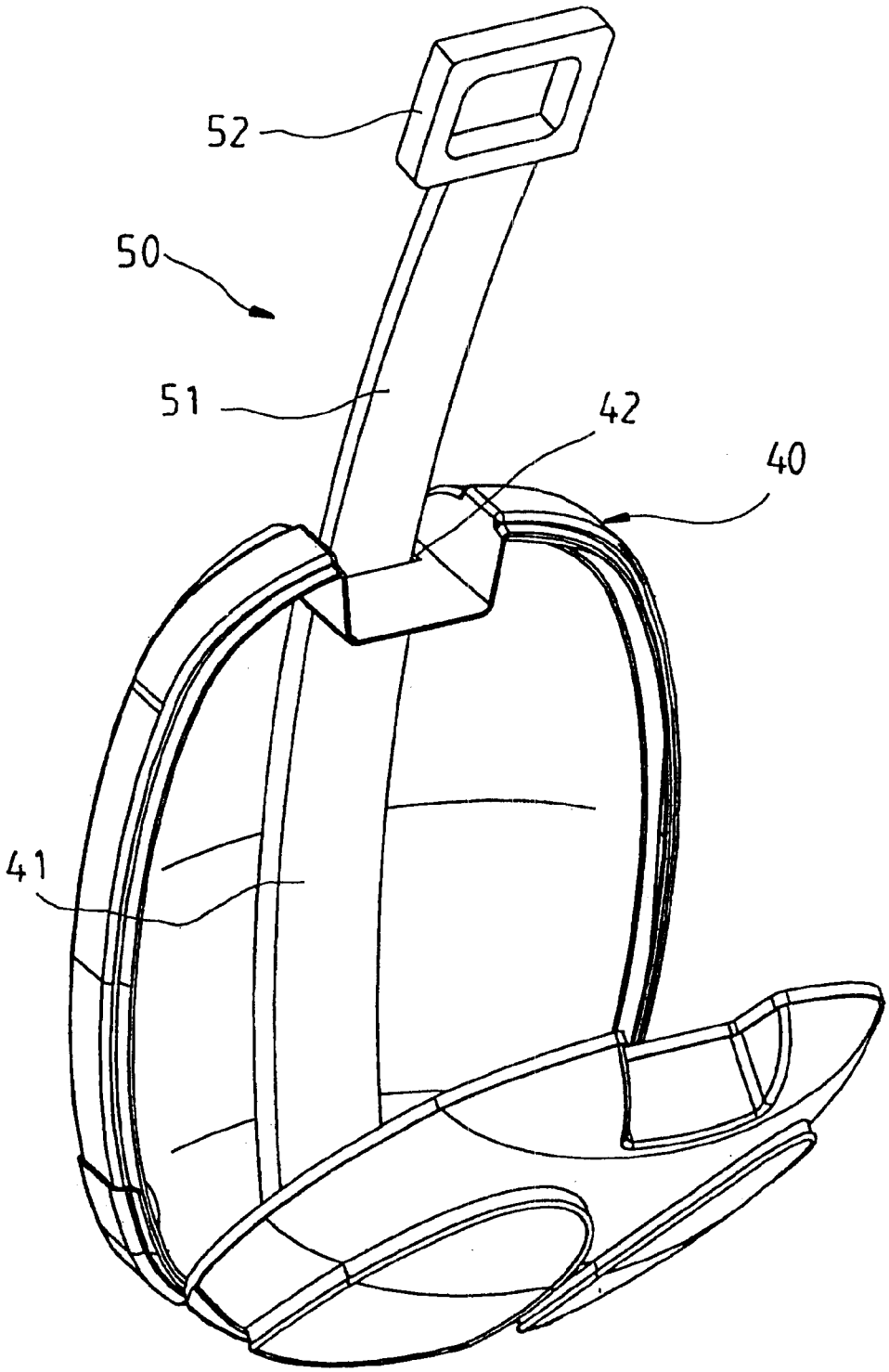
FIG. 6 is a perspective view of the second embodiment of the present invention.

As shown in FIG. 6, a second embodiment of the present invention has a wheeled luggage provided with the retractable handle, which comprise: a luggage case body 40, which has two wheels (not shown) at the bottom side thereof. A rail housing 41 fixed at the inner side of the luggage case body 40 to form a slide rail between the rail housing 41 and the case body 40. The slide rail also extended curved in this embodiment. The case body 40 has an opening 42 on the top side thereof engaged at the top end of the slide rail. A handle device 50 has a connecting means 51 and a grip 52, wherein the connecting means 51 is an elongated and elastic belt, and the grip 52 provided at the outer end of the connecting means 51. The connecting means 51 of the handle device 50 inserted into the opening 42 to slidably engage with the slide rail of the case body 40 for the handle device 50 moving between a collapsed position, in which the handle device 50 moved towards to the case body 40 with the grip 52 against on the case body 40, and an extending position, in which the handle device 50 moved outwards to the case body 40 in a predetermined distance.

What is claimed is:

1. A case having a retractable handle comprising:

two coplanar slide rails;

an elongated handle device having two connecting means respectively fixed to ends of the handle device;

each of the two connecting means being formed as an elastic belt respectively engaged to slide in the two slide rails;

wherein the handle device is moveable between a collapsed position in which the handle device is moved against the case and an extended position in which the handle device is moved away from the case a predetermined distance; and wherein when the handle device is moved to either the collapsed or extended position spacing between the two coplanar slide rails urges a free end of each said elastic belt away from each other so as to produce close engagement between each said elastic belt and a corresponding slide rail.

2. The case as defined in claim 1, further comprising two rail housings on lateral sides of the case respectively forming said two slide rails in between said rail housings and the case.

3. The case as defined in claim 2, wherein said rail housings are located on an inner side of the case; two openings provided respectively on the case through said slide rails to respectively receive each said elastic belt to engage in said slide rails.

4. The case as defined in claim 1, wherein said handle device further comprises a grip portion at the central part thereof.

5. The case as defined in claim 4, wherein the case has a case handle; wherein when said handle device is moved to the collapsed position, said grip portion of said handle device lies against said case handle of the case.

6. The case as defined in claim 3, wherein the case further has a slot under said case handle.

7. The case as defined in claim 1, wherein said handle device further comprises two curved means each of which is a rigid body shaping said handle device.

8. The case as defined in claim 1, wherein each said elastic belt has stop means for preventing said elastic belt from escaping the corresponding slide rail.

9. The case as defined in claim 1, further comprising position means for positioning said handle device at the collapsed position and the extended position.

10. The case as defined in claim 9, wherein said position means comprise two slots in each of the slide rails; a spring and a ball installed in a hole in tie elastic belt, wherein said ball can engage with said slots for positioning said handle device at the collapsed position and the extended position.

11. The case as defined in claim 1, wherein said slide rails are curved outward of case.

12. A case having a retractable handle comprising:

a curved slide rail;

an elongated handle device having connecting means fixed to an end of the handle device;

the connecting means being formed as an elastic belt engaged to slide in the slide rail;

wherein the handle device is moveable between a collapsed position in which the handle device is moved against the case and an extended position in which the handle device is moved away from the case a predetermined distance; and wherein when the handle device is moved to either the collapsed or extended position the elastic belt is urged to engage the curved slide rail so as to produce close engagement between the elastic belt and the curved slide rail.

13. The case as defined in claim 12, wherein further comprising a rail housing, provided on the case to form said slide rail in between said rail housings and the case.

14. The case as defined in claim 13, wherein said rail housing is provided on the inner side of the case; an opening provided on the case for inserting the elastic belt into engagement with said curved slide rail.

15. The case as defined in claim 12, further comprising means for positioning said handle device at the collapsed position and the extending position.

16. A case having a retractable handle comprising:

two coplanar slide rails;

an elongated handle device having two connecting means respectively fixed to ends of the handle device;

each of the two connecting means being formed as an elastic belt respectively engaged to slide in the two slide rails;

wherein the handle device is moveable between a collapsed position in which the handle device is moved against the case and an extended position in which the handle device is moved away from the case a predetermined distance;

wherein when the handle device is moved to either the collapsed or extended position spacing between the two coplanar slide rails urges a free end of each said elastic belt away from each other so as to produce close engagement between each said elastic belt and a corresponding slide rail;

wherein the case has a case handle; and wherein when said handle device is moved to the collapsed position; said grip portion of said handle device lies against said case handle.

17. The case as defined in claim 16, wherein the case further has a slot under said case handle.

18. The case as defined in claim 16, wherein said slide rails each have two slots therein, a spring and a ball being installed on the elastic belt, wherein said ball can engage with said slots for positioning said handle device at the collapsed position and the extended position.

19. The case as defined in claim 16, wherein said slide rails are curved.

* * * * *